US005509318A

United States Patent [19]

Gomes

[11] Patent Number: 5,509,318

[45] Date of Patent: Apr. 23, 1996

[54] MEMORY MOPET

[75] Inventor: Francis Gomes, Jersey City, N.J.

[73] Assignee: Manostat Corporation, New York, N.Y.

[21] Appl. No.: 136,575

[22] Filed: Oct. 13, 1993

[51] Int. Cl.[6] ..... B01L 3/02; G01N 1/14

[52] U.S. Cl. ..... 73/864.11; 73/864.14; 73/863.01

[58] Field of Search ..... 73/864.11, 864.14, 73/864.18, 863.83, 863; 422/100

[56] References Cited

U.S. PATENT DOCUMENTS

| | | | |
|---|---|---|---|
| 3,786,683 | 1/1974 | Berman et al. | 73/864.14 |
| 4,195,526 | 4/1980 | Amos et al. | 73/864.11 |
| 4,821,586 | 4/1989 | Scordato et al. | 73/864.14 |
| 4,896,270 | 1/1990 | Kalmakis et al. | 364/479 |
| 4,905,526 | 3/1990 | Magnussen, Jr. et al. | 73/864.18 |

OTHER PUBLICATIONS

Drummond Scientific Company, Drummond Pipet–Aids commercial brochure, 1993.

Manostat Corp., Pipettors—Safe, Portable Pipetting Aids commerical brochure, Oct. 1992.

Hamilton Company, Digital Syringe for the Most Accurate Precise Data commercial brochure, Jun. 1995.

Labor Aktuell Labortechnische Informationsschrift, Technomara AG Pipettieren,, per Pipetboy" ist schneller und müheloser, exakter und sauberer and vor allem sicherer, commerical brochure.

Rainin Instrument Co., Inc., EDPA 2 Battery Operated Motorized Pipette commercial brochure, Sep. 1987.

Matrix Technologies Corp., Electrapette Replacement System For Graduate Pipettes commercial brochure, Sep. 1985.

Monostat Corp., Varistaltic Pumps commercial brochure.

Alphamedics Mfg. Corp., Fluid Aspirator Decanter Model AS–100 commercial brochure.

Rainin Instrument Co., Inc., The Rainin Rabbit Peristaltic Pump commercial brochure, 1980.

Cole Parmer Instrument Co., Masterflex Tubing Pump Systems commercial brochure, 1987.

Watson–Marlow, 503S Pump commerical brochure.

LKB, 12000. VarioPerpex, Low–pulsation Peristaltic Pumping commercial brochure.

Cole–Parmer Instrument Co., Ismatec Pumps commercial brochure.

Instech Laboratories, Lambda Pump—Model 700, Low Flow Precision Peristaltic Pump commercial brochure.

*Primary Examiner*—Richard Chilcot
*Assistant Examiner*—Max H. Noori
*Attorney, Agent, or Firm*—Rosen, Dainow & Jacobs

[57] ABSTRACT

A hand-held automatic pipetting apparatus operable with a standard glass or plastic pipet for aspirating and dispensing a predetermined amount of liquid, comprising a housing including a handle and a pipette adapter for holding a pipette, an electric motor carried by the housing, a peristaltic pump carried by the housing and driven by said motor, conduit means communicating said pump with said pipette adapter when coupled to said pipette adapter, and control means for activating the motor and pump.

34 Claims, 8 Drawing Sheets

FIG. 8
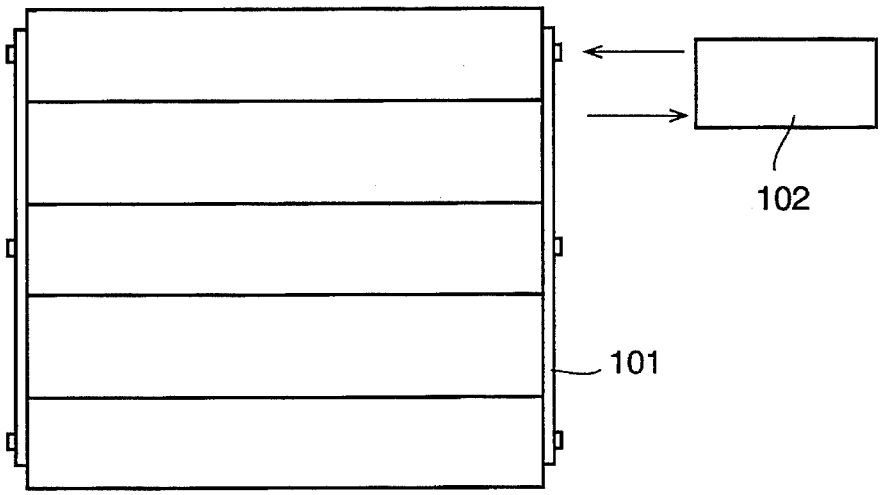
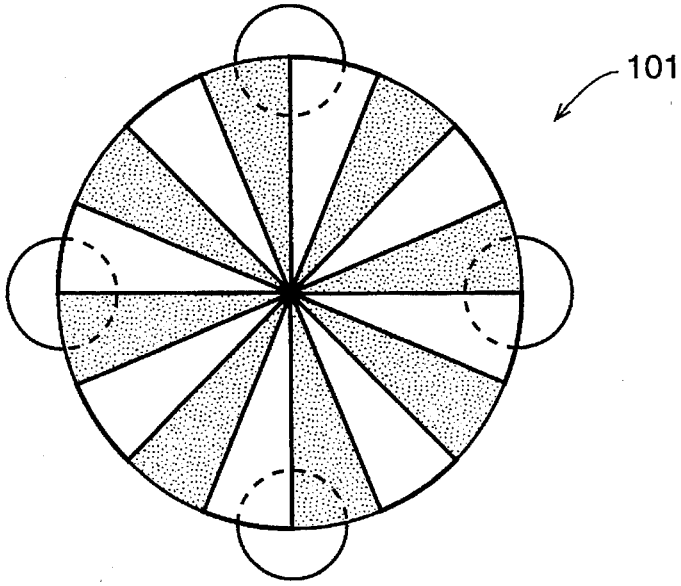
FIG. 9

MEMORY MOPET

BACKGROUND OF THE INVENTION

1. Field of the Invention

This invention relates to motorized and automated pipetting devices, and to electronically controlled apparatus having memory capability for aspirating and/or dispensing a pre-determined quantity or quantities of liquid. This invention is particularly related to a pipette gun type apparatus which is programmable to automatically dispense or aspirate uniform amounts of liquid.

2. Related Inventions

This invention is related to inventions disclosed in U.S. Pat. No. 3,963,061 which issued Jun. 15, 1976; U.S. Pat. No. 4,475,666 which issued Oct. 9, 1984; U.S. Pat. No. 5,090, 255 which issued Feb. 25, 1992; U.S. Pat. No. 4,967,606 which issued Nov. 6, 1990; U.S. Pat. No, 4,448,752 which issued May 15, 1984; and U.S. Pat. No. 4,896,270 which issued Jan. 23, 1990.

3. Background and Prior Art

Motorized and/or automatic pipetting devices of the prior art traditionally used and still use standard piston-type pumps to create suction or positive pressure for moving liquids. These types of pumps, while they are generally successful for the objectives set, have a variety of disadvantages. First, of course, are the structural requirements of a piston-cylinder mechanism having close tolerances, good seals, valves, valve seats and mechanisms to operate the valves and transmission assemblies to couple an electric motor to the piston. This kind of design automatically increases cost for manufacture and assembly of numerous precision parts and for wear, maintenance and replacement of parts. The second disadvantage is the difficulty or often impossibility to clean parts which are dirtied or contaminated by the fluids pumped. Where cleaning is even possible, time and expense is a major detraction. A third objection in some high speed operation pumps is the noise and/or vibration.

As indicated earlier, prior art and current automatic pipetors are such a great improvement over manual pipetting that users and manufacturers have widely accepted the basic electric motor piston-cylinder pump as the standard apparatus and focussed development efforts on other aspects of operation, such as electronic controls, better or different motors, valves for the pumps, and materials.

Other types of pumps exist and are used for appropriate functions, but not for hand-held pipetors, apparently for various reasons. A peristaltic type pump, for example, has not been used for hand-held automatic pipetors, first, because the essentially universal piston-cylinder pumps are a known and reliable and assumed entity, and second, because peristaltic pumps are traditionally used either for continuous through-flow or for liquids or both, and then only in stationary apparatus.

Each of the disadvantages of traditional and current automatic pipetors with piston-cylinder pumps discussed above have been resolved by either accepting the problem or by using more complex and expensive valving, motors and associated controls, or in the case of contaminated apparatus by simply discarding same.

The present invention utilizes a new combination of components and provides improvement in all the areas discussed as explained below.

SUMMARY OF THE INVENTION

The new Memory Mopet has fewer parts, less expensive parts, easily and inexpensively cleanable or replaceable parts, and high reliability. Also, it is easily coupled to electronic circuity to provide high accuracy of automatically repeatable aspiration or dispersion.

By using a peristaltic pump combined with the rotary output of an electric motor and optical scanning device for measuring rotation of the pump rotor and/or of the motor rotor, high accuracy and reliable repeatability is achieved at a fraction of the cost and prior art apparatus.

The new hand-held automatic pipetting apparatus is operable with any standard glass or plastic pipette for aspirating and/or dispensing a pre-determined amount of liquid. The apparatus includes a housing, part of which defines a handle and which has and carries within it a peristaltic pump driven by an electric motor. The pump conduit extends to a mouth portion of the apparatus which is connectable to a pipette. Control means are provided for activating the motor and pump so that rotation of the motor causes a correspondingly exact amount of liquid to be aspirated or dispensed through the outlet and the connected pipette. Rotation of the rotor portion of motor or of the rotor portion of the peristaltic pump is sensed by an optical sensor, measured and stored in the apparatus' memory.

In operation this Memory Mopet can be directed to suction or to aspirate a exact quantity of liquid, the value of this quantity being stored in memory. After dispensing this quantity of liquid, the apparatus can be used successively to aspirate exactly identical quantities automatically by simply directing the apparatus to repeat from memory, and allowing its memory to direct the motor to rotate an appropriate amount until the corresponding amount of liquid is aspirated each time and subsequently dispensed.

Obviously the optical sensor can be utilized to sense rotation of the pump when running in the opposite direction for dispensing liquid and thus can sense and determine an exact amount of liquid dispensed and can store that value in memory. Subsequently, the apparatus can be operated to dispense successive amounts, each exactly the same as the first amount simply by allowing the on-board computer to direct the motor to rotate in the effectively reverse direction to cause dispensing of liquid of the appropriate quantity.

BRIEF DESCRIPTION OF THE DRAWINGS

FIG. 8 is a fragmentary side elevation view of the pump rotor.

FIG. 9 is an end elevation view of the pump rotor of FIG. 8.

DETAILED DESCRIPTION OF THE PREFERRED EMBODIMENT

Figure 1:
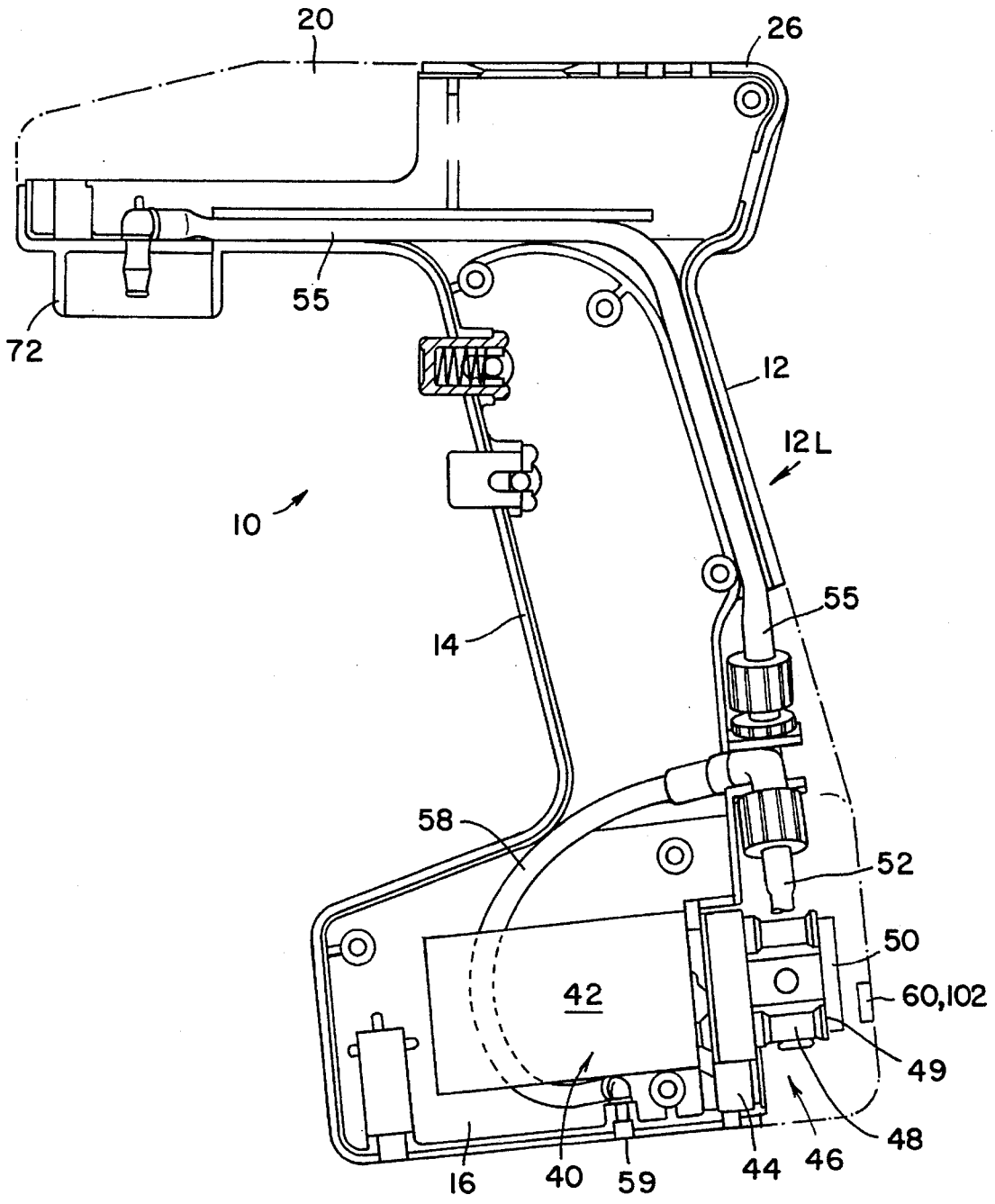
FIG. 1 is a side elevation view partially cut-away showing the housing and components of the new apparatus.

The new apparatus has principal components of housing 10, battery pack 24, indicator panel 26, motor-pump assembly 40, intake conduit 55, pipette adaptor collar 76, microcontroller 100 and optocoupler 102.

Figure 2:
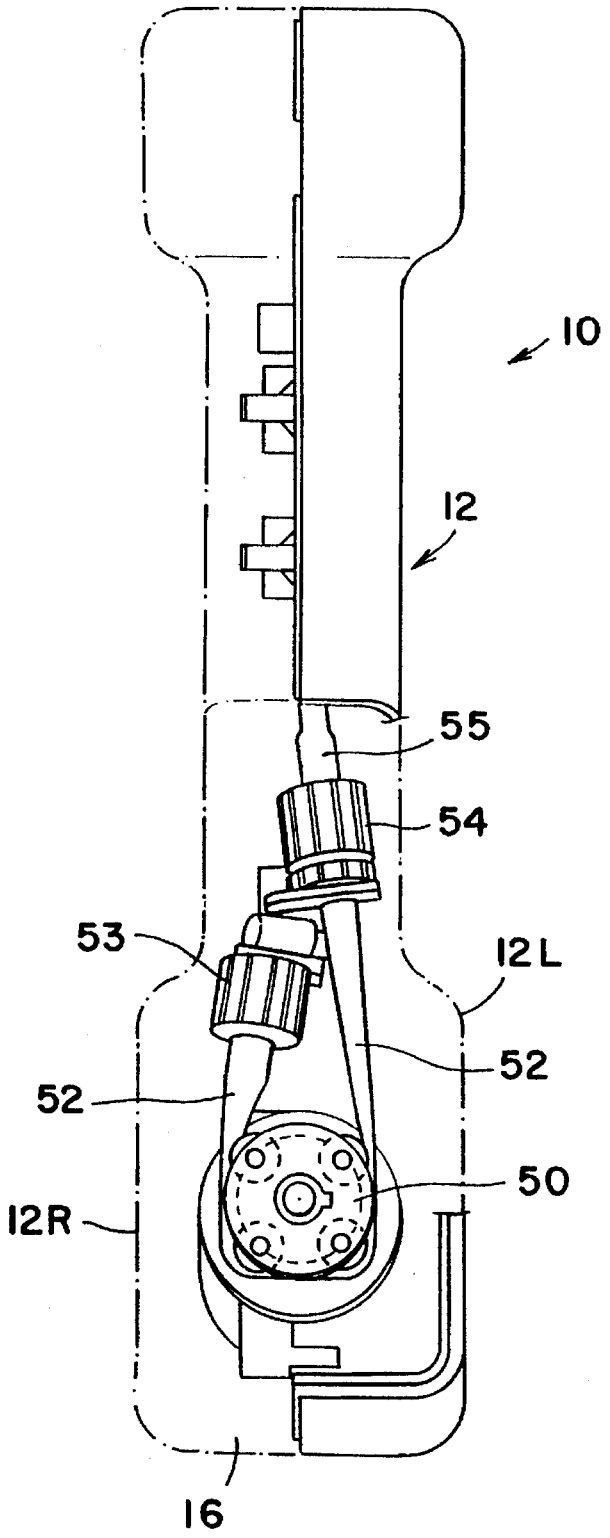
FIG. 2 is a rear end elevation view partly cut-away showing components of the peristaltic pump.

FIGS. 1–4 show the new apparatus 10 having a housing 12 which includes left and right sides 12L and 12R respectively. The right side is not shown in FIG. 1 because it is cut-away; FIG. 2 shows the left side 12L and the right side 12R indicated in dotted line. The left and right sides together form the housing 12, with a central portion thereof forming a handle 14 seen in FIGS. 1 and 3. The housing further defines a pump chamber 16 at the bottom with a pump cover 18 at the rear of the housing in FIG. 3. Also the housing defines a battery chamber 20 at the top thereof with a battery cover part 22, and within the chamber is a battery pack 24.

Rearward of the battery cover is a panel area 26 with a series of indicator lights LED1, LED2 and LED3 thereon to indicate the state of operation of the apparatus. Slightly forward of LED1 is a potentiometer knob 27 whose function is described later. On the inside surface of handle 14 are two triggers 28 and 29 whose function will also be discussed later.

Figure 3:
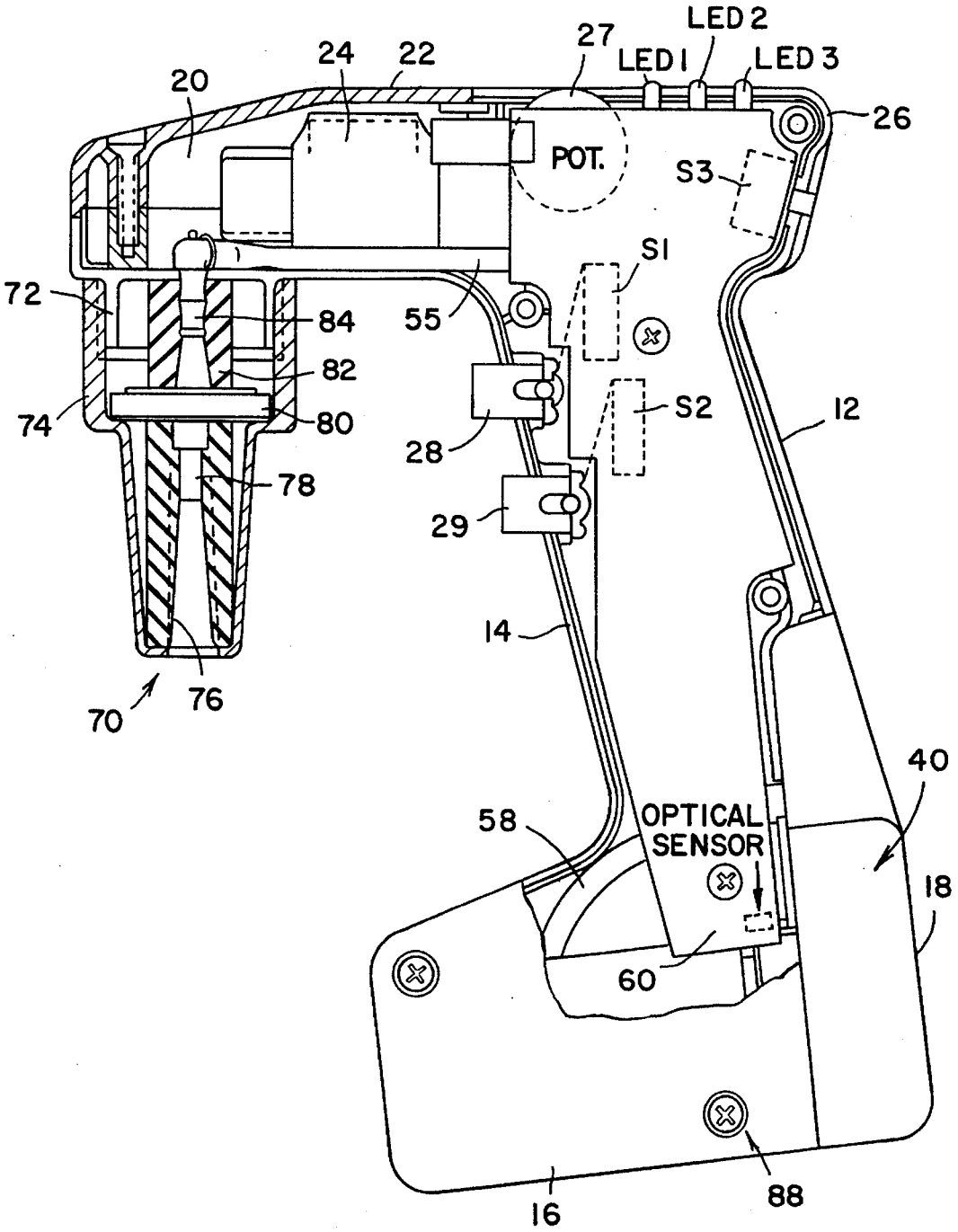
FIG. 3 is an elevation view similar to FIG. 1, but also showing the pipet adaptor.
Figure 4:
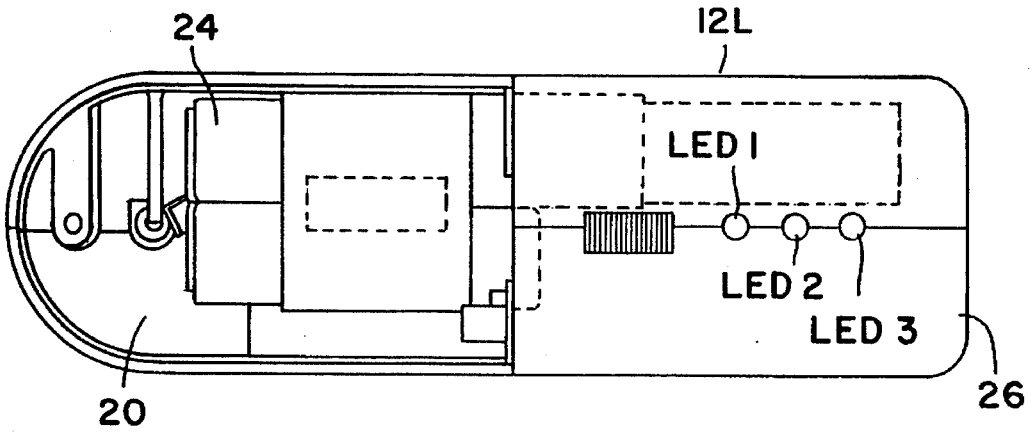
FIG. 4 is a top plan view shown partially cut-away showing the battery pack.
Figure 5:
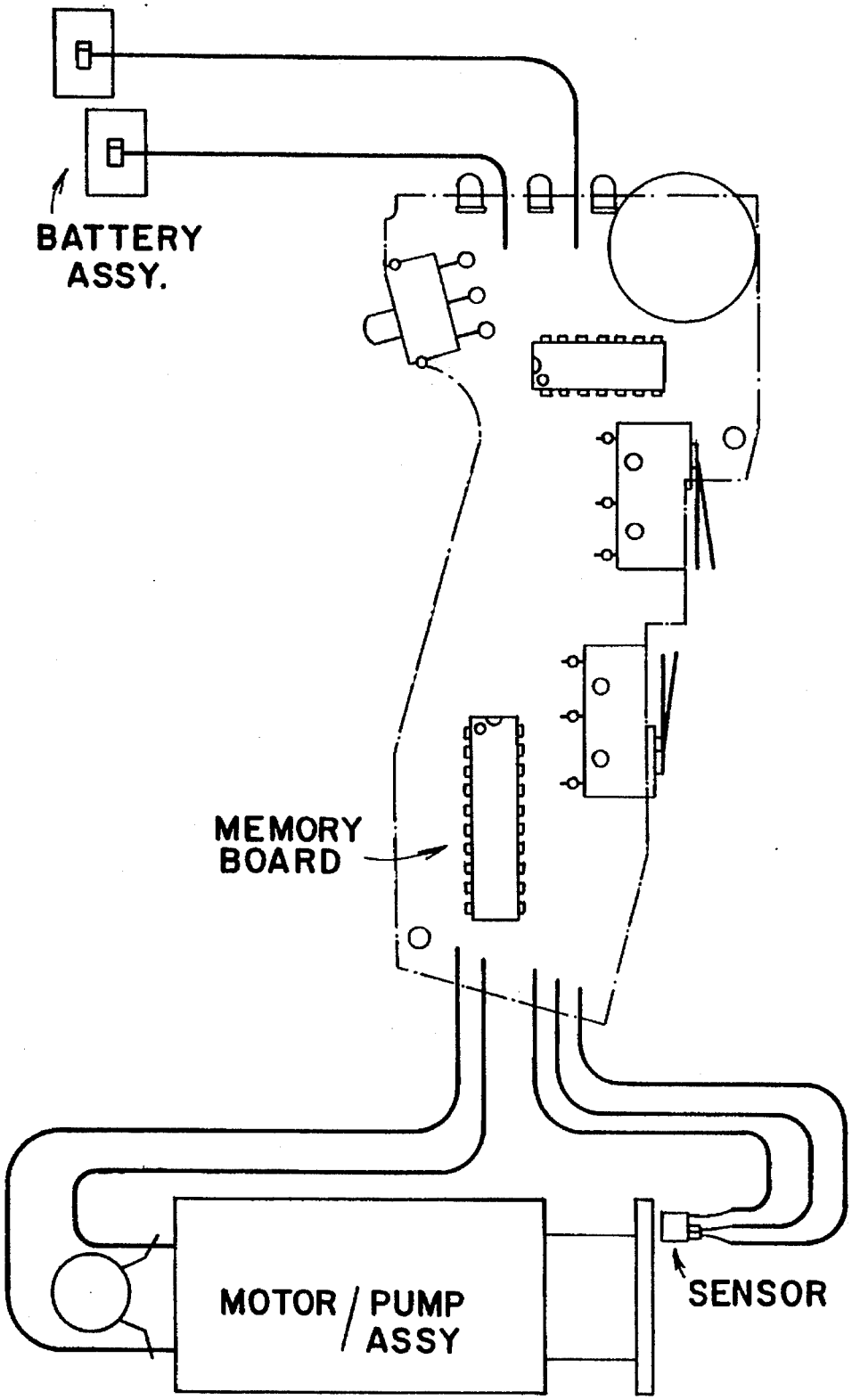
FIG. 5 is a schematic drawing of the fluid flow and basic controls.

Within the pump chamber 16 is a motor-pump assembly 40 located in FIGS. 1 and 2 which comprises a direct current electric motor 42, mounting means for the motor 44, a central drive shaft (not shown) of the motor, a pump rotor 46 rotated by the drive shaft, and a series of four rollers or pressure elements 48 carried by the rotor, each roller on its own axle 49 terminating in end plate 50. Also carried by the rotor is certain optical indicia to be described later for cooperation with an optical sensor 60 of optocoupler 102 as seen in FIGS. 3, 8 and 9 which will also be described later.

The peristaltic pump of the motor-pump assembly includes the principal pump conduit or pump link 52 seen in FIGS. 1 and 2. Conduit 52 loops about the four rollers 48 and terminates in coupling members 53 and 54 which securely engage the ends of conduit 52, wherein said pump comprises a compressible conduit for conveying said liquid and at least two spaced apart pressure elements for engaging said conduit at locations spaced lengthwise thereon, and for compressing said conduit as they are moved lengthwise on said conduit, From coupling 54 extends intake link or conduit 55 to the pipette adaptor 70; from coupling 53 extends vent link or conduit 58 to aperture 59 in the housing (FIG. 1) and to the atmosphere.

The housing 12 has a downward extending circular collar 72 which is externally threaded. A generally circular pipette housing 74 with internal threads at its upper end is removably screwed onto collar 72. Within this housing is a flexible and resilient pipette adaptor collar 76 for releasably receiving and securely gripping the top end of a pipette which when inserted in collar 72 engages over nipple 78 extending downward from a hydrophobic filter 80. Immediately above the filter is a filter seal 82 coupled to fitting 84 at the end of intake conduit 55. Thus, pump 40 communicates via pump conduit 52, intake conduit 55, fitting 84, filter seal 82, filter 80, nipple 78 and collar 72 to a pipette. The pipette adaptor housing 74 can be easily unscrewed from housing collar 72 to expose the pipette collar 76, filter 80 or seal 82 for cleaning or replacement.

Figure 6:
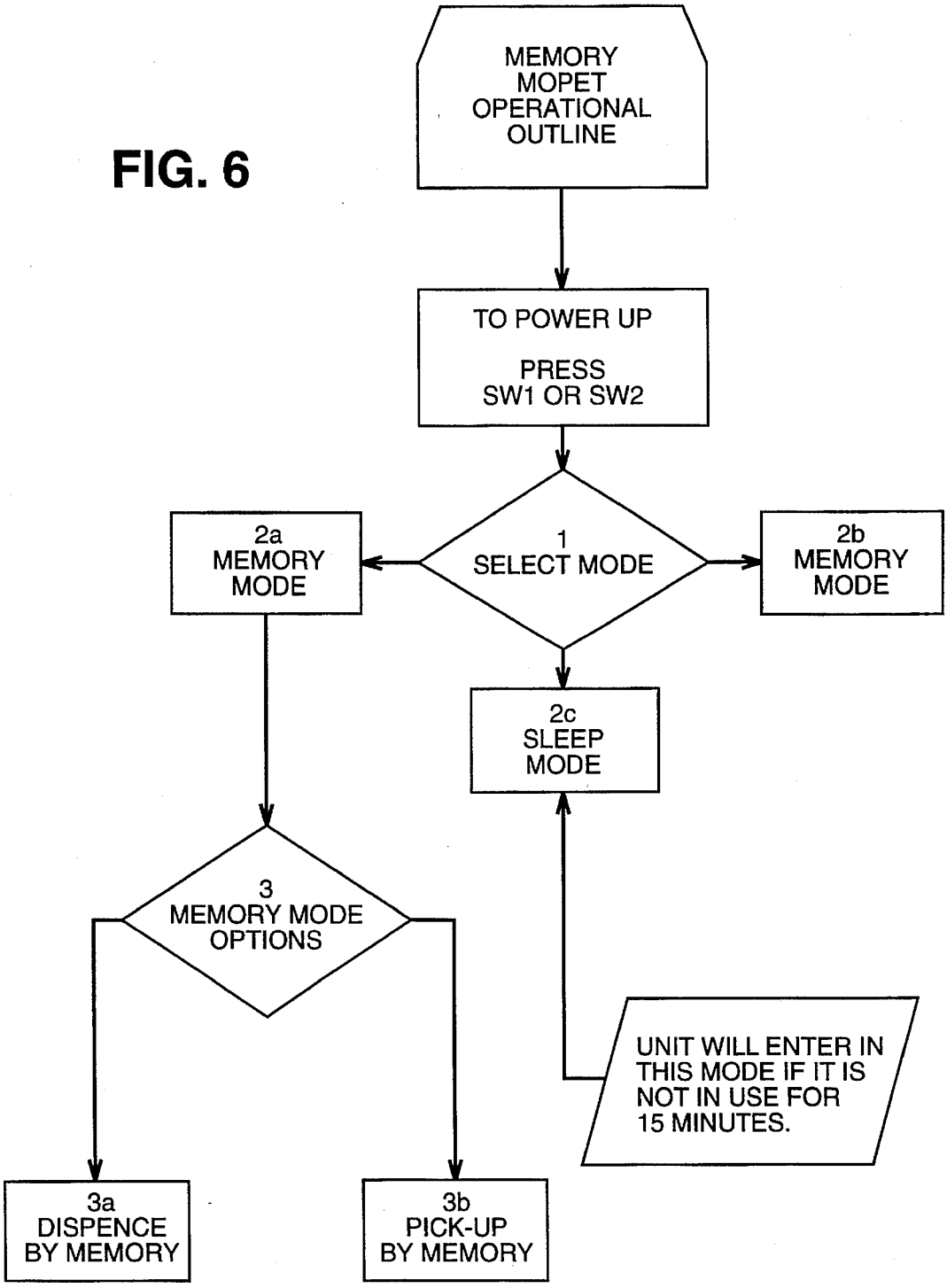
FIG. 6 is a flow chart diagram showing the operational modes of the apparatus.
Figure 7:
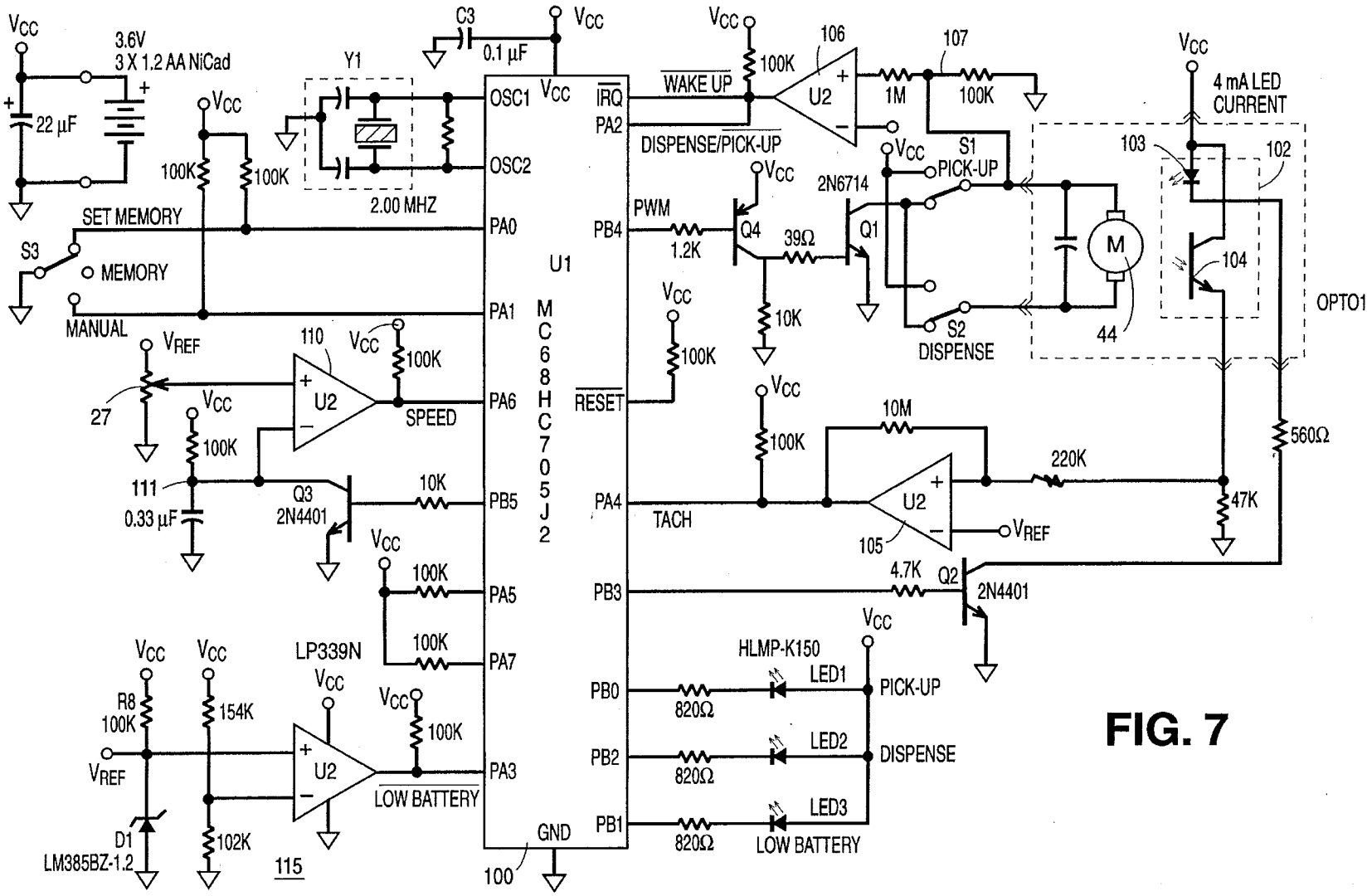
FIG. 7 is a circuit diagram showing the control circuity of the apparatus.

The electrical, mechanical and fluid flow operation is further described with reference to a flow chart of FIG. 6, a circuit diagram of FIG. 7 and an operational outline included herein as Appendix I. The circuit employed for the device of the present invention, as illustrated in FIG. 7 includes a microcontroller 100. This device may be, for example, a type MC68HC705J2, and includes a ROM storing a program for controlling the operation of the device of the invention.

The motor 44 is a reversible d.c. motor whose terminals are connected to separate center arms of the pick up and dispensing switches S1, S2. In the undepressed state of these switches, both of the center arms are connected to the collector of transistor switch Q1. The conductive state of this transistor is controlled by the logic level at port PB4 of the microcontroller, via the transistor Q4. When the transistor Q1 is controlled to be conductive, and either one of the switches S1, S2 is closed, an operating current is applied to the motor. The switches S1, S2 are selectively connected to $V_{cc}$ in their operative position, so that current applied to the motor flows in one direction when switch S1 is closed, and in the opposite direction when the switch S2 is closed, to enable the motor to be controlled to rotate its shaft in either direction. Since the microcontroller 100 can control the conductivity of the transistor switch Q1, it can inhibit rotation of the motor by rendering the switch Q1 non-conductive.

A disk 101 as indicated in FIGS. 1, 7, 8 and 9, is mounted to rotate with the shaft of the motor 44. The disk 101 is marked with a plurality of radially extending stripes equally distributed about its surface, to provide regularly angularly spaced black/white transitions. An optocoupler 102, as shown in FIG. 7, is comprised of an LED 103 mounted to direct light against the disk 101, and a phototransistor 104 is mounted to receive light reflected from the disk. As a result, the phototransistor outputs a pulse for each black/white transition of angular rotation of the disk, and hence of the motor shaft. These pulses are applied to port PA4 of the microcontroller via amplifier 105. The microcontroller may be connected to control energization of the LED 103, via the port PB3 and transistor Q2, in order to remove power from the LED during Sleep mode during which the voltage levels are set in the system to minimize current drain, whereby the microcontroller is responsive only to signals applied to its interrupt terminal IRQ.

Whenever the microcontroller detects that the motor has not been controlled to rotate for a predetermined time, due to the lack of depression of either of the switches S1, S2, for example by the absence of the application of a rotation count pulse to the port PA4 for the predetermined time, the program of the microcontroller recognizes that neither of the switches S1 and S2 is being depressed, and enters the Sleep mode. This predetermined time may be, for example, 15 minutes. In the Sleep mode, all outputs from the microcontroller are set to levels at which the circuit has minimum current drain, and the microcontroller is responsive only to an interrupt applied to the IRQ terminal.

The center arm of the switch S1 is also connected to the inverting input of an OPAMP 106, and the output of this OPAMP is applied to the IRQ terminal and port PA2 of the microcontroller. In the Sleep mode of the microcontroller, the signal output at port PB4 sets the transistor Q1 to its non-conductive state. In such a state, depressing the pick up switch S1 will apply a high logic level signal to the OP AMP 106, whereby the OP AMP outputs a low logic level to the interrupt terminal of the microcontroller. Similarly, depressing the switch S2 will also apply a high logic level to the input of OPAMP 106, due to the current path through the motor 44, since the resistance of the motor is less than that of the lower resistor of the resistive divider 107 connected the inverting terminal of the OPAMP 106. As a consequence, depression of either of the switches S1, S2 results in the application of a low logic level input to the IRQ terminal. This low input level invokes an interrupt subroutine to restore the microcontroller to its operating or wake-up state.

When the microcontroller is restored to its operating or wake-up state, an output of the port PB4 sets the transistor Q1 to its conductive state. Accordingly, the voltage applied to the OP AMP 106 will now be at a high logic level if the switch that invoked the interrupt routine was the pick up switch S1. The arm of the switch S1 is substantially at ground reference if it is not depressed; however, the output of the OP AMP will be at a logic low level if the switch that invoked the interrupt routine was the dispense switch S2. These logic levels, which are applied to the port PA2, thereby enable the program of the microcontroller to determine whether the motor 44 is running in a direction to direct fluid toward or away from the fitting 84.

The optocoupler 102 outputs a pulse to port PA4 of the microcontroller upon the detection of the passage of each black/white transition on the disk 101. i.e. for each angular displacement of the motor shaft. The program of the microcontroller counts these pulses, thereby enabling the storing of a value corresponding to the angular displacement of the motor shaft. As will be seen, if the direction of the rotation of the motor is reversed, by depressing the other of the switches S1 and S2, the resultant count during the time of depression of such other switch is subtracted from the previously stored count, while if the same switch is depressed again, a further count will be added to the stored value. Accordingly, a value may be continually stored in the memory of the microcontroller corresponding to a desired quantity of fluid that has been visually determined by the operator.

In order to enable control of the speed of the motor, the end terminals of the potentiometer 27 are connected between $V_{cc}$ and ground reference, and its arm is connected to the inverting input of the OP AMP 110, serving as a comparator. A series RC time constant circuit is connected between $V_{cc}$ and ground reference, with its junction connected to the noninverting input of the OP AMP 110. A signal output from the port PB5 of the microcontroller 100 is also applied, via transistor Q3, to the noninverting input of the OP AMP. The output of the OP AMP 110 is applied to port PA6 of the microcontroller. In this circuit, the position of the arm of the potentiometer 27 corresponds to the desired speed of the motor. In order to determine this speed, the microcontroller applies a pulse to the transistor Q3, to short circuit the charging capacitor of the time constant circuit 111, thereby bringing the noninverting terminal of the OP AMP to a low level. Following this pulse, the time constant circuit charges, thereby raising the voltage at the noninverting input of the OP AMP. When this voltages reaches that at the inverting input, the resultant output transition from the OP AMP is applied to the microcontroller. The time that elapses between the outputting of a pulse from the port PB5, and the receipt of a transition at the port PA6, is proportional to the desired speed of the motor 44. The program of the microcontroller controls the outputting of drive pulses to the motor, via the port PB4, at a rate corresponding to the above elapse of time between the pulse output at port PB5 and the application of a signal transition to the port PA6. Accordingly, the speed of the motor is controlled by the potentiometer 27, independently of other operating functions of the device.

As discussed above, the switch S3 has a manual position, a SET MEMORY position, and a MEMORY OPERATE position. In the circuit of FIG. 7, the SET MEMORY contact of the switch S3 is connected to the port PA0 of the microcontroller, and the MANUAL contact of this switch is connected to the port PA1 of the microcontroller. In the MANUAL position of the switch, the switches S1, S2 are operable, under manual control, to enable the operator to directly control the volume of air passing through the pump, independent of the length of time that the switch S1, S2 is depressed, and the speed of the motor that has been set by the potentiometer 27.

When the switch S3 is set to the SET memory position, the microcontroller is responsive to temporarily store the number of counts applied to its port PA4. This count corresponds to the angular displacement of the motor shaft for the time that the switch has been in the SET MEMORY position. The temporarily stored count is incremented for one direction of rotation of the shaft, and decremented for the opposite direction of rotation, in response to the operation of the switches S1 and S2. When the switch S3 is set to the MEMORY OPERATE position, following the temporary storage of a count in the SET MEMORY position, the temporarily stored count is stored in non-volatile memory, even though the switch S3 had been moved to the MANUAL position prior to being set to the OPERATE MEMORY position. The count that is stored corresponds to a fluid pickup, or a fluid dispense, storage, depending upon which of the switches S1, S2 was operated first following the initial setting of the switch S3 to the SET MEMORY position.

When the switch S3 is in the OPERATE MEMORY position, and the stored count corresponds to the pick up of fluid, operation of the switch S1 will effect the pick up of the amount of fluid corresponding to the stored count. If the switch S2 is operated at this time, the pipette can be emptied, the emptied amount not necessarily corresponding to the stored count. Similarly, when the switch is in the OPERATE MEMORY position and the stored count corresponds to the dispensing of fluid, operation of the switch S2 effects the dispensing of an amount of fluid corresponding to the stored count, and operation of the switch S1 effects the loading of the pipette to an amount not necessarily corresponding to the stored count.

In order to simplify the operation of the device, three LEDs are connected to separate ports of the microcontroller. LED1 corresponds to the picking up of fluid, LED2 corresponds to the dispensing of fluid, and LED3 corresponds to a low battery condition. When the switch S3 is in the MANUAL POSITION, LED1 and LED2 are controlled to flash alternately, until either the switch S1 or the switch S2 is depressed, in which case only the one of these LEDs that corresponds to the depressed switch will flash. Similarly, both LED1 and LED2 are controlled to flash alternately when the switch S3 is initially set to the SET MEMORY position, and after one of the switches S1, S2 is depressed, only that LED corresponding to the first depressed switch S1, S2 will continue to flash, in order to apprise the operator whether the set count corresponds to the pick up or dispensing of fluid.

When the switch S3 is set to the OPERATE MEMORY position, only that LED will flash that corresponds to the pick up or dispense conditions of the stored count.

The circuit illustrated in FIG. 7 further includes a low battery sensing circuit 115 connected to port PA3. When the microcontroller senses a signal at this port, it controls the energization of the low battery signal light LED3.

In the circuit of FIG. 7 the OP AMPS may be of type LP339N. Suitable components for the transistors are illustrated on the drawing.

In the operation of the circuit if the fluid is to be picked up or dispensed without automatic control of the volume, the switch S3 is set to the MANUAL position, the switches S1 and S2 are controlled as desired to pick up and dispense fluid.

When it is desired to calibrate the device to automatically pick up or dispense a determined volume of fluid, the switch S3 is set to the SET MEMORY position. If the determined volume is be picked up, then the switch S1 is depressed until the device has picked up the desired volume, and if the volume is to correspond to an amount to dispense, the switch S2 is operated until the desired amount is dispensed. In this process, if it is desired to adjust the calibrated volume to be picked up or dispensed in response to the depression of the switches S1, S2, either of these switches may be subsequently operated to increase or decrease the volume. The desired volume may be optically determined, i.e. dependent upon the operator visually determining that the correct volume has been picked up or dispensed.

In order to store the volume that has been established when the switch S3 is set to the SET MEMORY position, the switch S3 is now placed in the OPERATE MEMORY position. If the stored value corresponds to a volume to be picked up, depression of the switch S1 will automatically cause the device to pick up that volume. In this case depression of the switch S2 will effect the dispensing of fluid irrespective of the stored value. On the other hand, if the stored value corresponds to a volume to be dispensed, depression of the switch S2 will automatically cause the device to dispense a volume of fluid corresponding to the stored value, while depression of the switch S1 will cause the device to pick up fluid irrespective of the stored value.

The speed of rotation of the motor can be adjusted at any time, independently of the other operation functions of the device, merely by adjusting the potentiometer 27 to attain the desired speed.

The preferred embodiment of the new invention disclosed herein replaces memory pipettes which measure actual displacement of liquid, with a new combination of a peristaltic pump and an optical sensor to measure indirectly the liquid displacement by the motor and pump's angular displacement. Furthermore, this peristaltic pump displaces air creating positive or negative pressure which displaces the liquid. In this device accuracy is better than 1% for volumes of from 0.1 to 25 ml. If contamination does occur with this apparatus, only flexible hoses 55, 52 and or 58 need be replaced.

Variations of this embodiment are easily possible to operate the motor from an external source or to utilize the apparatus as a continuous flow-through pump. In the memory pipette mode of operation calibration typically need be done only at the initiation of each session to account for differences in the liquid being displaced and the laboratory atmosphere or environment.

Some of the specific components of this preferred embodiment are set forth below, but substitutes of equivalent function are obviously selectable. The housing is made of ABS Cycolac T1000 molded plastic from General Electric Corp. with parts secured together by standard fasteners such as the screws 86 and 88 shown in FIG. 3. The motor is a 3.2 volt DC gearmotor, 250 mAmp at 45 mNm of torque, 1000 RPM, max. torque 45 mNm at 3.2 volt DC. The battery power pack provides 600 mAh using three AA cells. Obviously, this apparatus may be operated from an external electrical power source. Also, this apparatus may be operated in a continuous flow fluid aspiration or dispensing mode. This pump conduit 55 is silicone rubber, Durometer 55 +/− 5 Shore A, 3/32 inch i.d. and 1/32 inch wall thickness. The intake and vent conduits are made from essentially the same tubing material.

The optocoupler sensor is a combined LED and reflective detector assembly from Minneapolis Honeywell. The hydrophobic filter has a polypropylene casing with a Teflon® disc, 25 mm and pore size 0.2 μm. The microcontroller is supplied by Motorola Semiconductor Corp., U1: Micro Controller IC, Part #MC68HC705 and U2: Quad Comparator by National Semiconductor Corp., Part #LP339.

The above-described embodiment of this invention may take a variety of other forms and have a variety of substitute components still within the spirit of this invention and within the scope of the claims appended hereto.

MEMORY MOPET OPERATIONAL OUTLINE

POWER UP

Momentarily pressing the PICK-UP switch (S1) or DISPENSE Switch (S2) will turn on the unit.

PUMP SPEED CONTROL

Pick-up and dispense speed can be set by the Pot (R7) at any time in both Manual and Memory modes.

MANUAL MODE

Set MODE Switch (S3) to Manual (lower) position. PICK-UP LED (LED1) and DISPENSE LED (LED2) will be off. Press S1 to load the pipette and press S2 to empty the pipette.

MEMORY MODES

SET PICK-UP

Move S3 to MANUAL position and load the pipette by pressing S2. Move S3 in SET MEMORY (upper) position. LED1 and LED2 will flash alternately. Press S1 to load the desired amount in the pipette. LED1 will continue to flash. Press S2 to reduce the amount of liquid in the pipette if needed. Move S3 to MEMORY (CENTER) position to store the selected amount. LED1 will be on. Preset value will remain the same if switch S3 is moved to MANUAL and then returned to MEMORY position.

SET DISPENSE

Move S3 to MANUAL position and load pipette by pressing S1. Move S3 SET MEMORY position. LED1 AND LED2 will flash alternately. Press S2 to empty the desired amount from the pipette. LED2 will continue to flash. S1 can be used to increase the amount of the liquid if needed. Move S3 to the MEMORY position to store the selected amount. LED1 will be on. Preset value will remain the same even if S3 is moved to MANUAL and then to returned to MEMORY position.

PICK-UP BY MEMORY

Set S3 in the MEMORY position after following the SET PICK-UP procedure. LED2 will be on. Press and hold S1. Unit will load the preset amount of liquid in the pipette and stop. Use S2 to empty the pipette.

DISPENSE BY MEMORY

Set S3 in MEMORY position after following SET DISPENSE procedure. LED2 will be on. Use S1 to load pipette. Press and hold S2. Unit will stop when preset amount is dispensed from the pipette.

SLEEP MODE

Processor will enter in this mode if the unit is idle for 15 minutes. All output will be turned off, including the LED3. Unit will be reactivated if S1 and S2 is pressed momentarily.

LOW BATTERY

LOW BATTERY (LED3) will be on if battery voltage drops below 3.1V. Unit will have to be recharged as soon as possible. Unit will operate unreliably if battery voltage drops below 3.0V.

I claim:

1. A hand-held automatic pipetting apparatus operable with a standard glass or plastic pipet for aspirating and dispensing a predetermined amount of liquid, the apparatus comprising:

(a) a housing including a handle and a pipette adapter for holding a pipette, (b) an electric motor carried by the housing (c) a peristaltic pump carried by the housing and driven by said motor, (d) conduit means communicating said pump with said pipette adapter, and (e) control means for activating the motor and pump, wherein said pump comprises a compressible conduit for conveying said liquid and at least two spaced apart pressure elements for engaging and compressing said conduit at locations spaced lengthwise thereon as the pressure elements are moved lengthwise on said conduit, and means for moving each of said pressure elements lengthwise on said conduit successively into and out of pressure contact with said conduit, said apparatus operable selectively for continuous or intermittent aspirating and dispensing liquid.

2. Apparatus according to claim 1 wherein said peristaltic pump comprises a flexible and resilient tube which is cyclically compressed along axially successive locations, whereby said tube displaces through its bore a column of air for applying either negative or positive pressure to liquid in the pipette.

3. Apparatus according to claim 1 further comprising means coupled to the said pump or said motor for determining any quantity of liquid initially aspirated or dispensed.

4. Apparatus according to claim 3, further comprising means for storing a value representative of said determined quantity.

5. Apparatus according to claim 4, further comprising means for recalling said value, and means for controlling said motor to operate said pump and cause aspiration or dispensing of liquid of said same value.

6. Apparatus according to claim 3, wherein said means for determining the quantity of liquid comprises movable means associated with the said pump and whose degree of movement is representative of the quantity of liquid initially aspirated or dispensed, and means for sensing the degree of movement.

7. A hand-held automatic pipetting apparatus operable with a standard glass or plastic pipette for aspirating dispensing a predetermined amount of liquid, the apparatus comprising:

(a) a housing including a handle and a pipette adapter for holding a pipette, (b) an electric motor carried by the housing, (c) a peristaltic pump carried by the housing and driven by said motor and having a rotatable member whose rotation is representative of the amount of liquid pumped of the pump, conduit means communicating said pump with said pipette adapter, (e) control means for activating the motor and pump, wherein said pump comprises a compressible conduit for conveying said liquid and at least two spaced apart pressure elements for engaging and compressing said conduit at locations spaced lengthwise thereon as the pressure elements are moved lengthwise on said conduit, and means for moving each of said pressure elements lengthwise on said conduit successively into and out of pressure contact with said conduit, said apparatus operable selectively for continuous or intermittent aspirating and dispensing liquid, (f) further means coupled to the rotatable member for sensing the mount of rotation when the motor is activated to aspire or dispense a predetermined mount of the liquid and for converting same into an electrical signal, (g) means for storing the electrical signal, and (h) means for retrieving the stored electrical signal and using same to activate the motor to aspirate or dispense a like amount of liquid.

8. The apparatus of claim 7, wherein the stored electrical signal is a digital signal.

9. The apparatus of claim 7, wherein the sensing means comprises optical means.

10. The apparatus of claim 7, wherein said control means comprises memory means operable with said further means for repeatedly aspirating or dispensing the same quantity of a liquid.

11. The apparatus of claim 10, further comprising timing means for controlling the time of motor operation during aspiration or dispensing given volume of liquid when the apparatus is placed in its manual mode.

12. The apparatus of claim 11 further comprising means for indicating whether the apparatus is in its memory or manual mode.

13. Apparatus according to claim 10 wherein the pump has a rotor element with exposed optical scanning indicia thereon, and rotation of said rotor corresponds directly to the quantity of liquid moved by said pump, the apparatus further comprising sensor means for sensing rotation of said rotor for determining the quantity of liquid pumped, and circuit means for directing the value of said sensed quantity into said memory means.

14. Apparatus according to claim 13 wherein said rotor has sequential black and white indicia circumferentially spaced thereon, and said sensor means comprises an LED and phototransistor.

15. Apparatus according to claim 1 further comprising rechargeable battery means carried by said housing for providing electrical power to said motor.

16. Apparatus according to claim 10 further comprising means for switching said apparatus to operate in automatic mode or manual mode, where automatic mode includes use of said memory means to control aspiration or dispensing, and manual mode allows the user to control aspiration or dispensing.

17. Apparatus according to claim 1 wherein said control means further comprises first and second finger-operated switches on said handle, said first switch for directing said pump to apply a suction force and said second switch for reversing said pump to apply a positive pressure force.

18. A hand-held automatic pipetting apparatus operable with any standard glass or plastic pipet for aspirating and dispensing a predetermined amount of liquid, the apparatus comprising:

(a) a housing including a handle and a pipette adapter for holding a pipette, (b) an electric motor carried by the housing, (c) a peristaltic pump carded by the housing and driven by said motor, (d) conduit means communicating said pump with said pipette adapter when coupled to said pipette adapter, and (e) control means for activating the motor and pump, and a replaceable hydrophobic filter in the pipette adapter for use adjacent the mouth of a pipette secured thereto.

19. A hand-held automatic pipetting apparatus operable with any standard glass or plastic pipet for aspirating and dispensing a predetermined amount of liquid, the apparatus comprising:

(a) a housing including a handle and a pipette adapter for holding a pipette, (b) an electric motor carried by the housing, (c) a peristaltic pump carried by the housing and driven by said motor, (d) conduit means communicating said pump with said pipette adapter when coupled to said pipette adapter, and (e) control means for activating the motor and pump, wherein said pipette adapter comprises a resilient collar into which the mouth of a pipette is axially inserted and releasably secured.

20. A hand-held automatic pipetting apparatus operable with any standard glass or plastic pipet for aspirating and dispensing a predetermined amount of liquid, the apparatus comprising:

(a) a housing including a handle and a pipette adapter for holding a pipette, (b) an electric motor carried by the housing, (c) a peristaltic pump carded by the housing and driven by said motor, (d) conduit means communicating said pump with said pipette adapter when coupled to said pipette adapter, and (e) control means for activating the motor and pump, wherein said pump comprises a rotor with four circumferentially spaced rollers, a flexible conduit wrapped about said rollers, a connecting conduit coupled to and communicating each end of said conduit to the pipette adapter for communication with a pipette.

21. A hand-held automatic pipetting apparatus operable with any standard glass or plastic pipet for aspirating and dispensing a predetermined amount of liquid, the apparatus comprising;

(a) a housing including a handle and a pipette adapter for holding a pipette, (b) an electric motor carded by the housing, (c) a peristaltic pump carded by the housing and driven by said motor and having a rotatable member whose rotation is representative of the amount of liquid pumped of the pump, (d) conduit means communicating said pump with said pipette adapter, (e) control means for activating the motor and pump, (f) further means coupled to the rotatable member for sensing the amount of rotation when the motor is activated to aspire or dispense a predetermined amount of the liquid and for converting same into an electrical signal, (g) means for storing the electrical signal, and (h) means for retrieving the stored electrical signal and using same to activate the motor to aspirate or dispense a like amount of liquid wherein said control means comprises memory means operable with said further means for repeatedly aspirating or dispensing the same quantity of a liquid, or in manual mode and wherein said pump further comprises a venting conduit communicating said pump to the atmosphere.

22. Apparatus according to claim 1 wherein said motor has an output shaft coupled to said pump; and said control means comprising means for storing a value corresponding to a predetermined angular displacement of said motor shaft, and means responsive to said stored value for controlling said motor to rotate said shaft said predetermined angular displacement.

23. A hand-held automatic pipetting apparatus having a port operable with any standard glass or plastic pipette for aspirating and dispensing a liquid, comprising;

a housing;

an electric motor carded by said housing;

a peristaltic pump coupled to be driven by the shaft of said electric motor;

conduit means communicating said pump with said port, and control means connected to control said motor, and thereby said peristaltic pump:

said control means comprising means for storing a value corresponding to a predetermined angular displacement of said motor shaft, and means responsive to said stored value for controlling said motor to rotate said shaft said predetermined angular displacement, further comprising a hydrophobic filter in said conduit means for inhibiting the flow of liquid therethrough.

24. The hand-held automatic pipetting apparatus of claim 22 wherein said control means comprises first and second switches connected to control said motor for opposite directions of rotation of said motor shaft, and said means for storing comprises means responsive to the operation of said first and second switches for storing a value corresponding to a cumulative angular displacement of said shaft.

25. The hand-held automatic pipetting apparatus of claim 24 wherein said control means further comprises a microcontroller having a sleep mode at which power dissipation in said control means is minimized, and a wake-up mode in which said control means is operable, comprising means responsive to absence of operation of said first and second switches for a predetermined time for setting said microcontroller to said sleep mode, and means responsive to the operation of either of said first and second switches for setting said microcontroller to said wake-up mode.

26. A hand-held automatic pipetting apparatus having a port operable with any standard glass or plastic pipette for aspirating and dispensing a liquid, comprising:

a housing;

an electric motor carried by said housing;

a peristaltic pump coupled to be driven by the shaft of said electric motor;

conduit means communicating said pump with said port, and control means connected to control said motor, and thereby said peristaltic pump;

said control means comprising means for storing a value corresponding to a predetermined angular displacement of said motor shaft, and means responsive to said stored value for controlling said motor to rotate said shaft said predetermined angular displacement further comprising means for producing pulses that each correspond to a second predetermined angular displacement of said shaft, and said means for storing a value comprises means for storing a count corresponding to the number of said pulses.

27. The hand-held automatic pipetting apparatus of claim 22 further comprising means for adjusting the speed of rotation of said motor independently of said control means.

28. A hand-held automatic pipetting apparatus having a port operable with any standard glass or plastic pipette for aspirating and dispensing a liquid, comprising;

a housing;

an electric motor carried by said housing;

a peristaltic pump coupled to be driven by the shaft of said electric motor;

conduit means communicating said pump with said port, and control means connected to control said motor, and thereby said peristaltic pump;

said control means comprising means for storing a value corresponding to a predetermined angular displacement of said motor shaft, and means responsive to said stored value for controlling said motor to rotate said shaft said predetermined angular displacement, wherein said means for storing a value comprises means for providing a count corresponding a cumulative angular displacement of said shaft during first and second opposite directions of rotation of said shaft, wherein said value is said count.

29. The hand-held automatic pipetting apparatus of claim 28 wherein said means for providing a count comprises means for optically sensing angular displacement of said shaft.

30. The hand-held automatic pipetting apparatus of claim 29 wherein said means for controlling said motor comprises means for applying a plurality of pulses to said motor corresponding to said stored count.

31. An apparatus according to claim 1, wherein said pump comprises a rotor carrying said pressure elements and said rotor is continuously rotatable to produce continuous aspirating or dispensing.

32. An apparatus according to claim 1, wherein said pump comprises a rotor carrying said pressure elements and said rotor is rotatable at least 180°.

33. An apparatus according to claim 31, wherein said pump comprises a rotor and four compression elements equally spaced circumferentially on said rotor.

34. An apparatus according to claim 33, wherein said conduit is wrapped about said rotor and continuously contacts all the compression elements.

* * * * *